United States Patent [19]

Schmid

[11] 4,376,534

[45] Mar. 15, 1983

[54] BOWLING PIN CABLE ADJUSTMENT ARRANGEMENT

[75] Inventor: August Schmid, Schwerzenbach, Switzerland

[73] Assignee: Serania AG, Glarus, Switzerland

[21] Appl. No.: 259,069

[22] Filed: Apr. 30, 1981

[30] Foreign Application Priority Data

May 7, 1980 [CH] Switzerland ..... 3542/80

[51] Int. Cl.[3] ..... A63D 5/08

[52] U.S. Cl. ..... 273/44; 242/147 R

[58] Field of Search ..... 273/44; 242/147 R

[56] References Cited

FOREIGN PATENT DOCUMENTS 900521 5/1972 Canada ..... 273/44

2749281 5/1979 Fed. Rep. of Germany ..... 273/44

*Primary Examiner*—Anton O. Oechsle

*Attorney, Agent, or Firm*—Frishauf, Holtz, Goodman & Woodward

[57] ABSTRACT

To permit individual retensioning and readjustment of cable length, to compensate for stretch of cables (2) attached to the heads of bowling pins (1), each cable (2) is looped about an individual associated storage drum (6), which is secured to an individual rocker plate (9), held in a first predetermined or rest position by a spring (8). The storage drum is prevented from rotation in a cable pay-out direction by a ratchet (22, 28), but can be rotated in cable pick-up direction by an externally controllable cable tensioning drive. If the cable tension applied between the head of the pin and the storage drum exceeds the force of the restoring spring (8) applied to the rocker plate, the rocker plate will pivot, thus permitting engagement of the latch (28) of the ratchet with an electromagnetically positionable engagement element (10), thus permitting rotation of the storage drum in the cable pay-out direction (D).

7 Claims, 4 Drawing Figures

BOWLING PIN CABLE ADJUSTMENT ARRANGEMENT

Reference to related patents, by the inventor hereof, and assigned to the assignee of this application: U.S. Pat. Nos. 3,809,398; 3,810,617; 4,068,845.

The present invention relates to an arrangement for positioning of bowling pins, in which the pins are secured to cables and in which a rotatable cable supply drum is associated with each cable, positioned on a pivotable rocker element.

BACKGROUND

Bowling pin cable arrangements have the problem that the cables on which the pins are secured stretch with increased operating time. At least several ones of the bowling pins are then no longer pulled properly into a pin centering device. Inaccuracies upon placement of the pins on a bowling alley will then result thereby.

THE INVENTION

It is an object to solve the problem to provide readjustment of the cable, automatically, and with simple means.

Briefly, a support frame is provided on which cable storage drums having a predetermined length of cable wound thereon are secured, the cables forming, on the drum, at least a portion of a storage loop. A rocker element is pivotably mounted on the support frame, and resiliently biassed in a first or normal or rest position thereon. The storage drums are coupled to a ratchet which prevents rotation of the storage drum in a direction which would tend to feed cable from the storaage drum of the pin. To permit such feed, a controllable ratchet release means is provided, positionable to engage with the ratchet upon deflection of the rocker plate element, and hence of the ratchet, counter the resilient biassing force of the biassing means which, for example, is a spring, so that the ratchet will be released thereby to permit release of cable from the storage drum.

The system additionally provides for a wind-up mechanism to wind up cable on the storage drum after the pins have been positioned in a predetermined lifted and centered relationship, the wind-up means including a frictional element, such as a belt which can slip about a sheave and coupled to the storage drum so that the length of the cable between the storage drum and the particular centering device for all the pins will be the same, regardless of any intermediate stretching of individual cables which may have occurred in use. The pins, themselves, are positioned by a pull element which pulls a portion of the cable between the storage drum and the head of the pin laterally of the frame, so that the effective length of the cable between the centering element on the frame and the pin can be changed to position the pins on the floor of a bowling alley.

The arrangement permits rotation of the cable storage drum in a predetermined direction to carry out readjustment of the cable in an automatically operating manner.

DRAWINGS

The drawing illustrates an example of the subject matter of the invention. There is shown:

Figure 1:
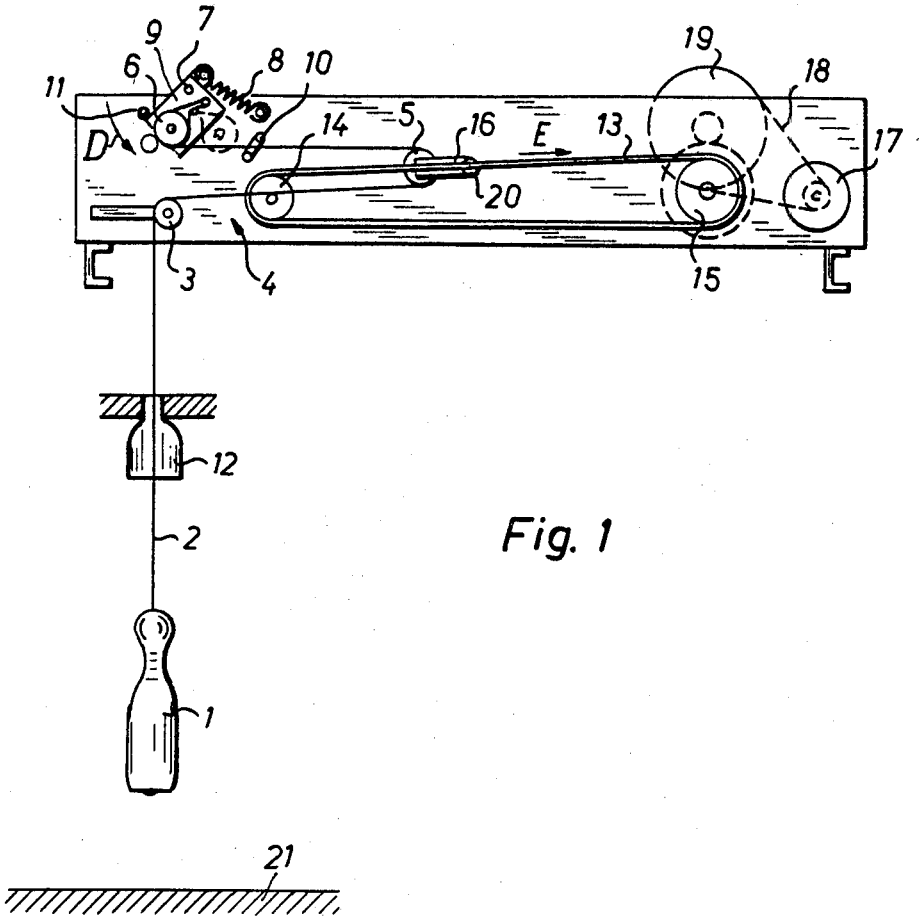
FIG. 1 is a schematic overall view of the pin positioning apparatus.
Figure 2:
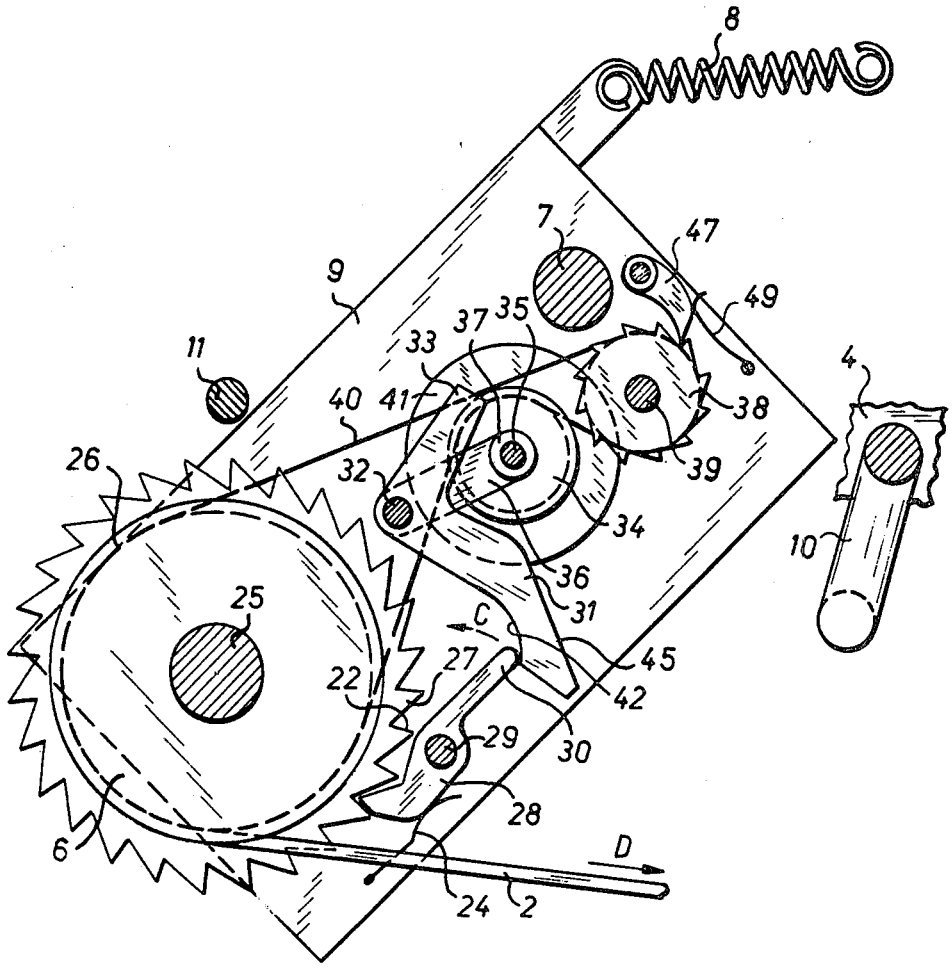
FIG. 2 is a view of the rocker element in quiescent position.
Figure 3:
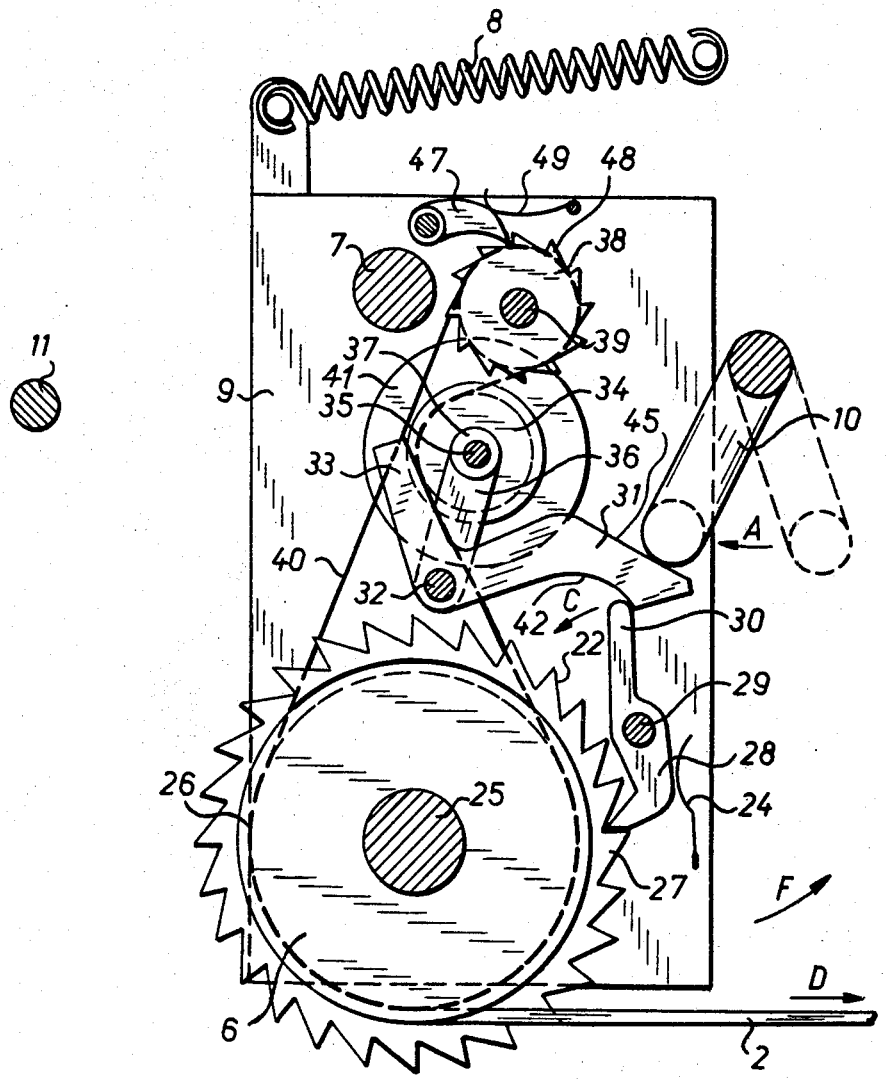
FIG. 3 is a view of the rocker in a first pivoted position.
Figure 4:
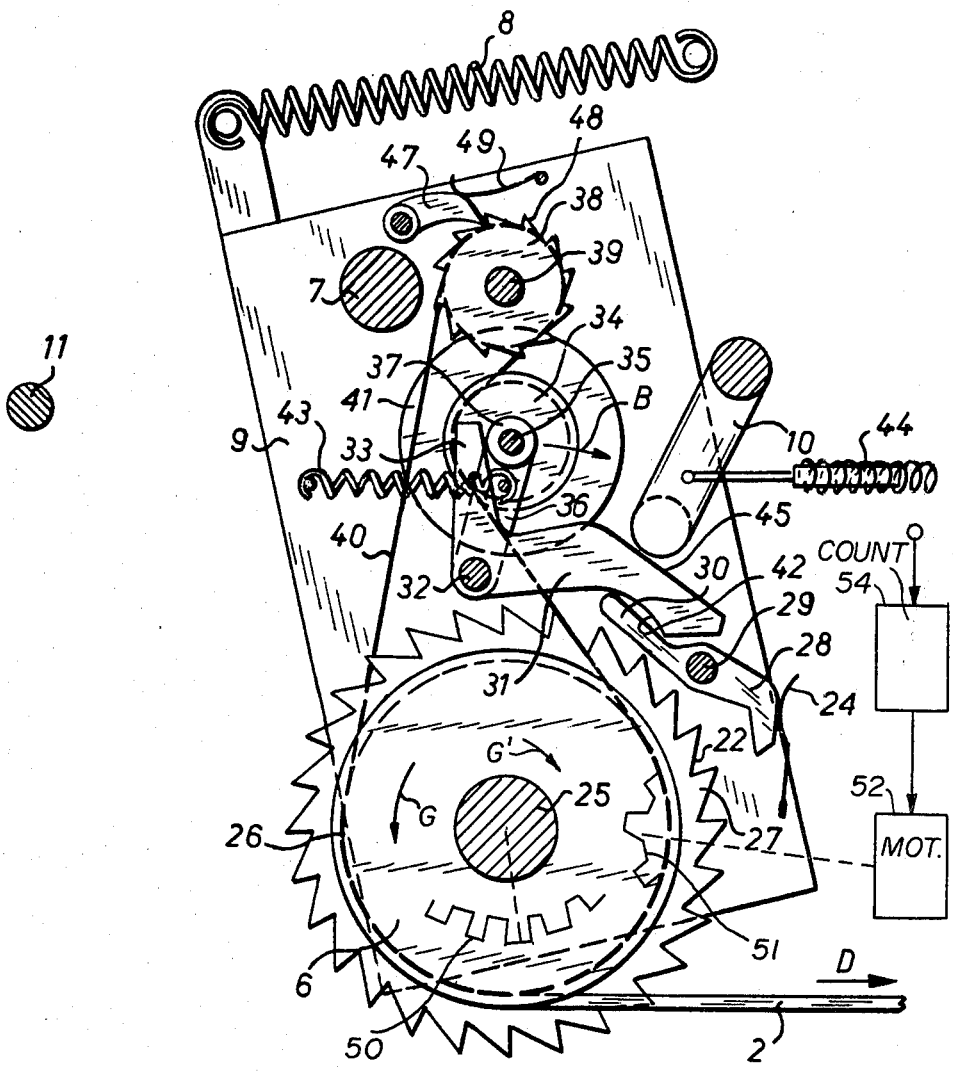
FIG. 4 is a view of the rocker in the final pivoted position.

Eight or nine bowling pins 1 are present in the pin positioning arrangement according to FIG. 1. Each pin 1 is secured to a flexible cable 2. Each cable 2 is passed over a deflection roller 3 which is rotatably held in a frame 4. The cables 2 are further guided over each one of respective cable rollers 5, which are secured to hangers 16 and which are connected by a common horizontal rod 20. Each end of the cable is guided to a cable storage drum 6 which is located on a pivotable rocker element 9. The cable storage drum 6 retains a reserve of cable and is rigidly coupled to a ratchet wheel 27 (FIGS. 2–4). Each rocker element 9 is separately journaled on a continuous horizontal pivot shaft 7. The continuous rod 20, to which the hangers 16 are secured, is connected at its both ends, each, with an endless chain 13. Each chain 13 is looped over deflection wheels 14, 15, so that a closed chain path is formed at the two ends of the frame 4. The two chains 13 are driven, in uniform sense of rotation, by an electric drive motor 17 which drives a relatively large drive wheel 19 via a V-belt 18. Intermediate wheels transfer this movement to the two chain deflection wheels 15. When the two chains 13 are moved in the direction of the arrow E, the pins 1 are pulled upwardly into their associated pin centering device 12. If the cable tension increases, for example if the pins 1 have tangled, or if any one of the pins due to shortened cable reaches the pin centering device 12 prematurely, an increased pull of the cable in the direction of the arrow D (FIGS. 2 to 4) causes pivoting of the rocker element 9 counter the force of the spring 8.

Upon further rotation of the chain, and hence of the rod 20, and when rod 20 has passed over wheel 15, and entered the lower portion or run of the chain, the pins 1 will again be lowered until they seat on the floor 21. The drive motor 17 is then stopped when the rod 20 is in the vicinity of the deflection roller 14. In this position, there will be a loose bight in the cable which permits falling of the pins 1 on the floor 21 upon being hit by a bowling ball.

FIGS. 2 to 4 show the rocker element 9 in various positions. In the quiescent position according to FIG. 2, the rocker 9 is placed by the pull of the spring 8 against an abutment 11 if no increased tension in the direction of the arrow D is placed on the cable 2. The cable supply drum 6 is locked against rotation in the pay-out direction of the cable by a ratchet lever 28 which engages in teeth 22 of a ratchet wheel 27 which is rigidly coupled to the cable storage drum 6. The cable storage drum 6 is journaled about a shaft 25 seated on the rocker element 9. The ratchet lever 28 is loaded by a spring 24 and is pivotable about a bolt 29 seated on the rocker element 9. An extension 30 remote from the ratchet engagement point cooperates with an angle lever 31 which is pivotably supported by a shaft 32.

A belt sheave 26 is coaxially and non-rotatably connected to the cable storage drum 6. A belt 40 is looped over the sheave 26. The belt 40 is further guided about a belt reversal roller 38 and is placed under tension by a belt tensioning roller 34. The belt tensioning roller 34 is located on a movable arm 36 which is seated on the same pivoting shaft 32 as the angle lever 31, but can pivot independently thereof. The belt tensioning roller 34 is loaded by a spring 43 in a direction to tension the belt. A sleeve 37 is located on a projecting shaft 35 of the belt tensioning roller 34, which is provided for association with the upper angle lever portion 33.

An operating element 10 which is journaled laterally of the rocker element 9 in the frame 4, and which can be engaged and disengaged by an electromagnet 44 (FIG. 4), permits opening of the ratchet lock so that the cable storage drum 6 can rotate and permit the cable 2 to be pulled in the direction of the arrow D.

The operating element 10 can be pivoted from the quiescent position shown in broken lines in FIG. 3 into a preparatory position shown in full line, and held therein by means of electromagnet 44 (not shown in FIG. 3). If, subsequently, tension is placed on the cable 2 which exceeds the normal cable tension in the direction of the arrow D, the rocker element 9 will pivot in a direction of the arrow F (FIG. 3) counter the effect of the spring 8. The rocker element 9 will then assume the position illustrated in FIG. 3. The operating element 10 will engage against the upper edge 45 of the angle lever 31 if the operating element 10 assumes the preparatory position illustrated in FIG. 3 in full lines. Unless the operating element 10 in the meanwhile has been pivoted in the direction of the arrow A by the electromagnet 44, it will be outside of the operating path of the angle lever 31 and does not influence the same. Upon further deflection of the rocking element 9 in the direction of the arrow F as the consequence of an increased cable tension in the direction of the arrow D, and if the operating element 10 is in the preparatory position, the parts will then assume the position shown in FIG. 4. The operating element 10 then presses on the edge 45 of the angle lever 31, to cause the locking lever 28 to become disengaged from the ratchet wheel 27. As a consequence, the cable storage drum 6 can rotate in the direction of the arrow G (FIG. 4) upon overcoming a torque, since the belt 40 can slip on the belt sheave 26. This permits a draw-off movement of the cable in the direction of the arrow D although the latch 47, loaded by the spring 49, is in engagement with a ratcheting circumference 48 of the belt reversal roller 38. Upon still more extensive pivoting of the rocking element 9 in the direction of the arrow F, the belt 40 is unloaded, since the upper lever portion 33 will then engage against the sleeve 37 and press the arm 36 with the belt tensioning roller 34 counter the tension of a spring 43 in the direction of the arrow B (FIG. 4) so that the belt 40 is unloaded.

The belt tensioning roller 34 is rigidly secured with a disk 41 which has a larger diameter, and as large a mass as possible. The effect thereof is that, by a sudden jolt-like movement of the rocking element 9 back into the quiescent position, that is, a movement counter the arrow F, the mass will prevent overrun of movement of the belt.

An apparatus shown only schematically, and to the extent necessary for understanding, rotates the belt drum from time to time in the direction of cable storage rotation, see arrow G', FIG. 4 by a partial circumferential rotation, for example by 2 to 4 ratchet teeth. This is achieved by an automatic control. A gear 50, non-rotatably secured to the cable storage drum 6, is coupled to a gear 51 which rotates slowly, or makes partial angular rotations. Upon a subsequent pull-up of the pins 1, increased cable tension will be applied on the rocking elements 9, causing pivoting of the rocking element 9. Since this will have the result of disengaging the latch levers 28, the cable will be fed out in the direction of the arrow D. Thus, possibly different lengths of cables are equalized, so that, thereafter, the length of the cables of all the pins 1 are again equal.

The partial rotation and equalization of length of the cables coupled to individual pins can be carried out, automatically, for example under control of a counter 54 counting a predetermined number of raising and lowering operations of the pins e.g. by counting signals applied to a counter terminal. For example, gear 50 can be coupled directly to the shaft 25, and hence to the respective cable storage drums 6 which, in turn, is coupled through gearing 51 to motor 52 which is sequentially energized to effect the aforementioned slow or partial rotation of the storage drums 6. Since the centering devices 12, for example in cup shape and fitting against the heads of the pins 1, are all located at a fixed predetermined height over the floor 21 of the bowling alley, and the rollers 3 as well as the rollers 5 over which the cable 2 is looped, will all be at a predetermined, for example the same axially aligned position, the length of the cable between the respective storage drum 6 to the cups will be equalized. Any stretching of individual cables will thus be automatically compensated.

Various changes and modifications may be made within the scope of the inventive concept.

I claim:

1. In a bowling pin positioning apparatus having a plurality of bowling pins (1), including individual cable means (2) secured to the heads of the pins for suspending the pins, a bowling pin cable adjustment arrangement having a support frame (4);

individual cable storage drums (6), each having a predetermined length of cable wound thereon in at least a portion of one storage loop;

a plurality of rocker plate elements (9) pivotably mounted on the support frame (4);

resilient biassing means (8) holding said rocker plate elements in predetermined position on the frame;

a ratchet (22,28) preventing rotation of the storage drums in a direction (D) of feeding cable from the storage drum to the respective pin;

controllable ratchet release means (10) positionable for engagement with the ratchet latch (28) upon deflection of the rocker plate element (9) and hence of the ratchet counter the resilient biassing means (8) to then permit release of cable from the storage drum;

means (5, 16, 13, 17, 18, 19) in engagement with the cable means (2) and selectively controlling the length of cable between the frame and the pins to thereby position the pins on the floor of a bowling alley, or at an elevated position thereabove;

a belt sheave (26) rotatable secured to the cable storage drum (6);

a belt (40) being looped about said belt sheave (26);

a spring-loaded belt tensioning roller (34) in engagement with said belt;

and operating means (31) engageable by said controllable ratchet release means (10) and with said belt tensioning roller (34) to unload the belt tensioning roller when said rocker plate element (9) has pivoted from said predetermined position and said ratchet release means has unlatched the ratchet latch (28).

2. Apparatus according to claim 1 further including brake means (34, 40, 41, 47, 48, 49) coupled to the storage drum and counteracting rotation of the storage drum in cable pay-out direction upon release of said ratchet.

3. Apparatus according to claim 1, further including a belt sheave (26) rotatably secured to the cable storage drum (6);

a belt (40) being looped about said belt sheave (26);

a spring-loaded belt tensioning roller (34) in engagement with said belt;

and operating means (31) engageable by said controllable ratchet release means (10) and with said belt tensioning roller (34) to unload the belt tensioning roller when said rocker plate element (9) has pivoted from said predetermined position and said ratchet release means has unlatched the ratchet latch (28).

4. Apparatus according to claim 1, wherein the cable storage drum (6) and the belt sheave (26) are coaxially positioned;

and the operating means comprises an angled lever (31) in engagement with said ratchet latch lever (28).

5. Apparatus according to claim 1, further including an inertia disk (41) having a greater diameter than the belt tensioning roller (34) and non-rotatably coupled thereto, the inertia of said disk counteracting rapid movement of the belt (40) upon restoration of the rocker plate element to said predetermined position under force of said resilient biassing means (8) subsequent to deflection thereof from said predetermined position.

6. Apparatus according to claim 1, further including means (12) positioned a predetermined distance above the floor of the bowling alley, and engageable with the heads of the pins to provide a top fixed position of the pins;

cable tensioning means engageable with the respective storage drums and selectively movable to move the storage drums in a direction to tighten the cables thereabout, engagement of the pins with the stop means causing tension to be applied on the cables tending to overcome the tension of the resilient biassing means and permitting deflection of the rocker plate element (9) to pivot from said predetermined position and permit rotation of the storage drum counter the direction of rotation applied thereto by said cable tensioning means and pay-out of just so much cable from the storage drum as necessary to cover the distance from the storage drum to the head of the pin in engagement with the head engagement means upon return of the rocker plate element to said predetermined position, and reengagement of said ratchet.

7. In a bowling pin positioning apparatus having a plurality of bowling pins (1), including individual cable means (2) secured to the heads of the pins for suspending the pins, a bowling pin cable adjustment arrangement having a support frame (4);

individual cable storage drums (6), each having a predetermined length of cable wound thereon in at least a portion of one storage loop;

a plurality of rocker plate elements (9) pivotably mounted on the support frame (4);

resilient biassing means (8) holding said rocker plate elements in predetermined position on the frame;

a ratchet (22,28) preventing rotation of the storage drums in a direction (D) of feeding cable from the storage drum to the respective pin;

controllable ratchet release means (10) positionable for engagement with the ratchet latch (28) upon deflection of the rocker plate element (9) and hence of the ratchet counter the resilient biassing means (8) to then permit release of cable from the storage drum;

means (5, 16, 13, 17, 18, 19) in engagement with the cable means (2) and selectively controlling the length of cable between the frame and the pins to thereby position the pins on the floor of a bowling alley, or at an elevated position thereabove;

means (12) positioned a predetermined distance above the floor of the bowling alley, and engageable with the heads of the pins (1) to provide a top fixed position of the pins;

cable tensioning means (50,51,52) engageable with the respective storage drums (6) and selectively movable to move the storage drums in a direction (G') to tighten the cables thereabout, engagement of the pins with the stop means (12) causing tension to be applied on the cables (2) tending to overcome the tension of the resilient biassing means (8) and permitting deflection of the rocker plate element (9) to pivot from said predetermined position and permit rotation of the storage drum (6) counter the direction of rotation applied thereto by said cable tensioning means and pay-out of just so much cable from the storage drum as necessary to cover the distance from the storage drum to the head of the pin (2) in engagement with the head engagement means (12) upon return of the rocker plate element to said predetermined position, and reengagement of said ratchet (22,28).

* * * * *

UNITED STATES PATENT AND TRADEMARK OFFICE

CERTIFICATE OF CORRECTION

PATENT NO. : 4,376,534

DATED : March 15, 1983

INVENTOR(S) : August SCHMID

It is certified that error appears in the above—identified patent and that said Letters Patent is hereby corrected as shown below:

Col. 4, line 67 (claim 2), change "claim 1" to -- claim 1 Or 7 --.

Col. 5, line 4 (claim 3), change "claim 1" to -- claim 7 --.

Col. 5, line 17 (claim 4), change "claim 1" to -- claim 1 Or 7 --.

Col. 5, line 23 (claim 5), change "claim 1" to -- claim 1 or 7 --.

Col. 3, line 59, delete "see arrow G', Fig. 4", and insert in Col. 3, line 60 after rotation --- see arrow G', Fig. 4 ---.

Signed and Sealed this

*Twenty-fourth* Day of *January 1984*

[SEAL]

*Attest:*

GERALD J. MOSSINGHOFF

*Attesting Officer*

*Commissioner of Patents and Trademarks*